US009266164B2

(12) United States Patent
Wilcox et al.

(10) Patent No.: US 9,266,164 B2
(45) Date of Patent: Feb. 23, 2016

(54) EXTREME OFFSET NOSE ASSEMBLY WITH SECONDARY BEARING

(71) Applicant: Alcoa Inc., Pittsburgh, PA (US)

(72) Inventors: Robert Wilcox, Port Ewen, NY (US); Nicholas Gougoutris, Kingston, NY (US)

(73) Assignee: Alcoa Inc., Pittsburgh, PA (US)

( * ) Notice: Subject to any disclaimer, the term of this patent is extended or adjusted under 35 U.S.C. 154(b) by 49 days.

(21) Appl. No.: 14/208,705

(22) Filed: Mar. 13, 2014

(65) Prior Publication Data

US 2014/0259585 A1 Sep. 18, 2014

Related U.S. Application Data

(60) Provisional application No. 61/791,024, filed on Mar. 15, 2013.

(51) Int. Cl.
*B23P 19/04* (2006.01)
*B21J 15/02* (2006.01)

(52) U.S. Cl.
CPC ..... *B21J 15/022* (2013.01); *Y10T 29/53796* (2015.01)

(58) Field of Classification Search
USPC ..... 29/244
See application file for complete search history.

(56) References Cited

U.S. PATENT DOCUMENTS 3,713,321 A 1/1973 LaPointe
4,615,206 A 10/1986 Rosier
4,796,455 A * 1/1989 Rosier ..... 72/391.2
4,813,261 A * 3/1989 Rosier ..... 29/243.522
4,879,875 A * 11/1989 Davert et al. ..... 60/588
4,896,522 A * 1/1990 Rosier ..... 29/243.521
5,371,933 A 12/1994 Godfrey
6,516,510 B1 * 2/2003 Fulbright ..... 29/715
6,662,420 B1 * 12/2003 Rosier ..... 29/243.529

(Continued)

FOREIGN PATENT DOCUMENTS

CN 86102208 A 2/1987
CN 102145481 A 8/2011

(Continued)

OTHER PUBLICATIONS

International Search Report and Written Opinion dated Sep. 18, 2014, issued by the European Patent Office in International (PCT) Application No. PCT/US2014/025808 (10 pages).

*Primary Examiner* — Lee D Wilson
*Assistant Examiner* — Alvin Grant
(74) *Attorney, Agent, or Firm* — Greenberg Traurig, LLP

(57) ABSTRACT

A nose assembly for a fastener installation tool including an anvil, a collet, and a drawbar having a primary bearing. A secondary bearing is positioned within the collet and located intermediate the primary bearing and jaws of the collet. The secondary bearing is offset from the fastener centerline by a first distance and from a pulling tool centerline axis defined by a longitudinal axis of the drawbar by a second distance. In a pull position, the primary bearing remains engaged with the anvil during a loaded stroke and limits anvil deflection relative to the fastener centerline, while the secondary bearing remains engaged with the collet during the loaded stroke and limits deflection of the collet relative to the fastener centerline. In a return position, the primary bearing remains engaged with the anvil during a return stroke, while the secondary bearing remains engaged with the collet during the return stroke.

15 Claims, 5 Drawing Sheets

(56) References Cited

U.S. PATENT DOCUMENTS

| | | | | |
|---|---|---|---|---|
| 6,739,170 | B1 | 5/2004 | Rosier | |
| 6,854,178 | B2 * | 2/2005 | Fritsche et al. | 29/813 |
| 7,458,245 | B1 | 12/2008 | Wilcox | |
| 7,631,534 | B2 | 12/2009 | Wilcox | |
| 7,665,342 | B2 * | 2/2010 | Cobzaru et al. | 72/391.2 |

FOREIGN PATENT DOCUMENTS

| | | |
|---|---|---|
| CN | 203779452 U | 8/2014 |
| WO | 86/05723 | 10/1986 |

* cited by examiner

EXTREME OFFSET NOSE ASSEMBLY WITH SECONDARY BEARING

CROSS-REFERENCE TO RELATED APPLICATION

This application is a Section 111(a) application relating to and claiming the benefit of commonly owned, U.S. Provisional Patent Application Ser. No. 61/791,024 entitled "EXTREME OFFSET NOSE ASSEMBLY WITH SECONDARY BEARING," filed Mar. 15, 2013, the entirety of which is incorporated herein by reference.

FIELD OF THE INVENTION

The present invention relates to fastener installation tools, and, more particularly, to fastener installation tools having extreme offset nose assemblies.

BACKGROUND OF THE INVENTION

A fastener installation tool having an extreme offset nose assembly is utilized when the fastener centerline is offset at a relatively large distance from the tool. There is a need to limit the deflection of the nose assembly when installing the fastener.

SUMMARY OF THE INVENTION

In an embodiment, a nose assembly for a fastener installation tool including an anvil; a collet disposed within the anvil, the collet including jaws; a drawbar supported by the anvil and the collet, the drawbar having a first end, a second end opposite the first end, and a primary bearing located at the first end; and a secondary bearing positioned within the collet and located intermediate the primary bearing of the drawbar and the jaws of the collet. In an embodiment, the secondary bearing is located proximate to a fastener centerline defined by a longitudinal axis of the jaws. In an embodiment, the secondary bearing is offset from the fastener centerline by a first distance and is offset from a pulling tool centerline axis defined by a longitudinal axis of the drawbar by a second distance. In an embodiment, the first distance is less than the second distance.

In an embodiment, the nose assembly is adapted to be activated in a pull position, such that the primary bearing remains engaged with the anvil during a loaded stroke and limits anvil deflection relative to the fastener center line and supports an installation load, while the secondary bearing remains engaged with the collet during the loaded stroke and limits deflection of the collet relative to the fastener center line. In an embodiment, the nose assembly is adapted to be activated in a return position, such that the primary bearing remains engaged with the anvil during a return stroke, while the secondary bearing remains engaged with the collet during the return stroke.

In an embodiment, the secondary bearing is attached to the collet and engaged with the anvil. In an embodiment, the secondary bearing is fastened threadedly to the collet. In an embodiment, the secondary bearing is retained to the collet by a retaining ring. In an embodiment, the secondary bearing is retained to the collet by a retainer clip. In an embodiment, the collet includes an aperture having internal threads and the drawbar includes external threads that engage threadedly the internal threads of the aperture of the collet. In an embodiment, the drawbar includes a rear bearing located intermediate the first and second ends of the drawbar. In an embodiment, the anvil is a swaging anvil. In an embodiment, the anvil is a stand-off anvil. In an embodiment, the drawbar includes a stop located at the second end thereof. In an embodiment, the nose assembly includes a deflector in communication with the collet.

DETAILED DESCRIPTION OF THE DRAWINGS

Figure 1:
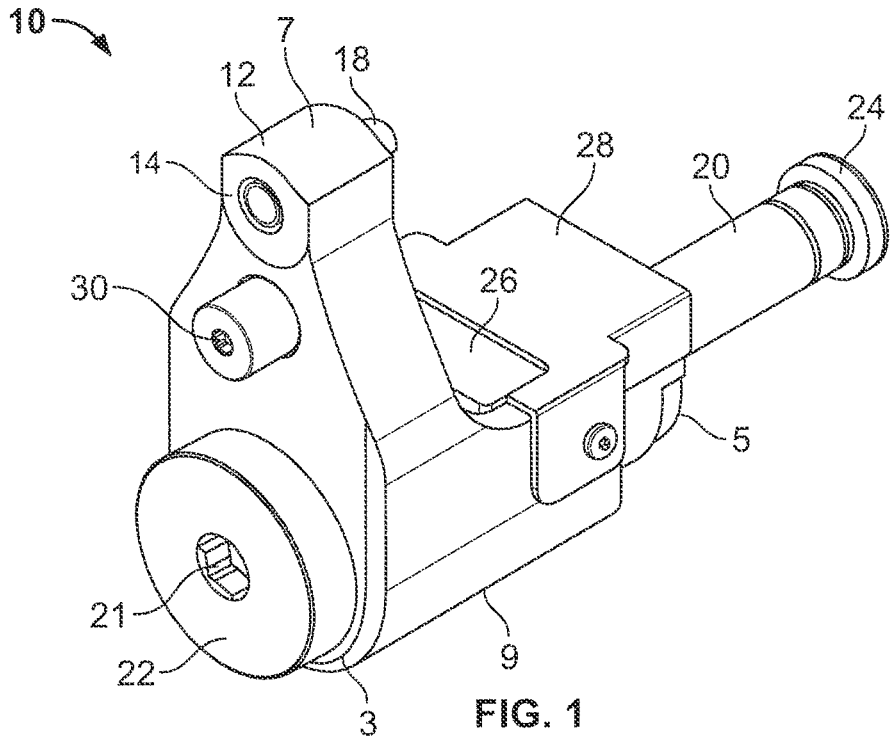
FIG. 1 is a front perspective view of a nose assembly for a fastener installation tool constructed in accordance with an embodiment.
Figure 2:
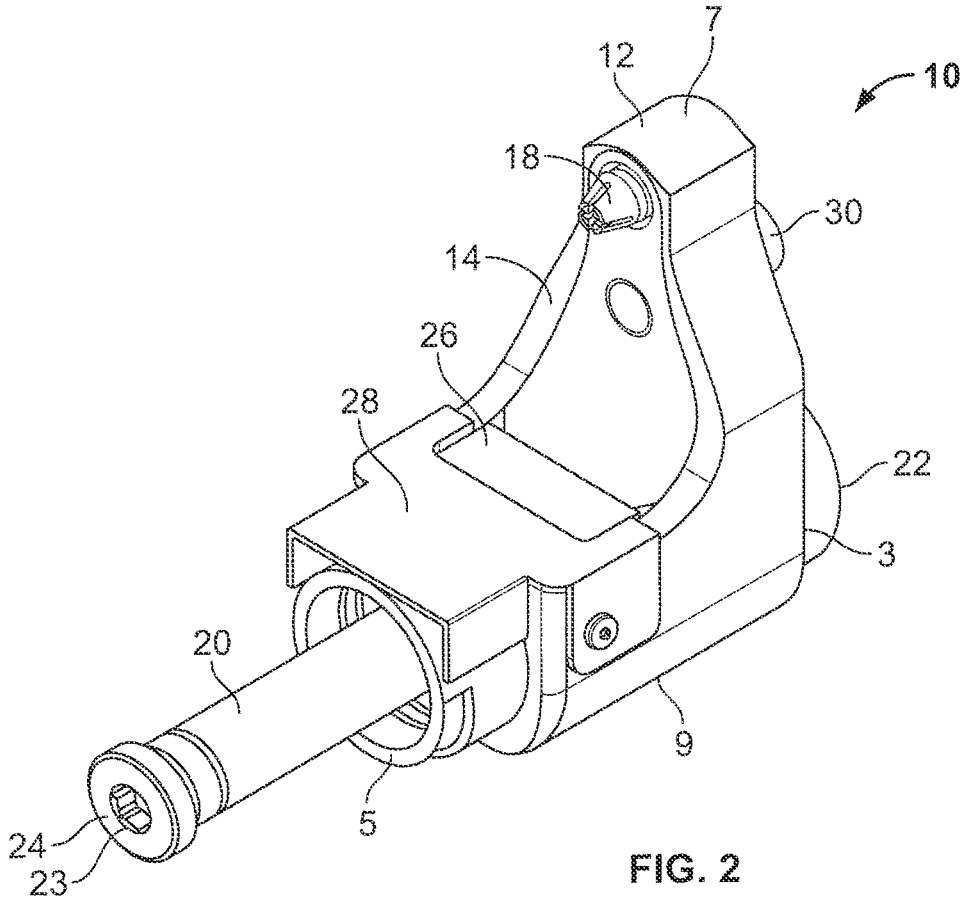
FIG. 2 is a rear perspective view of the nose assembly shown in FIG. 1.
Figure 3:
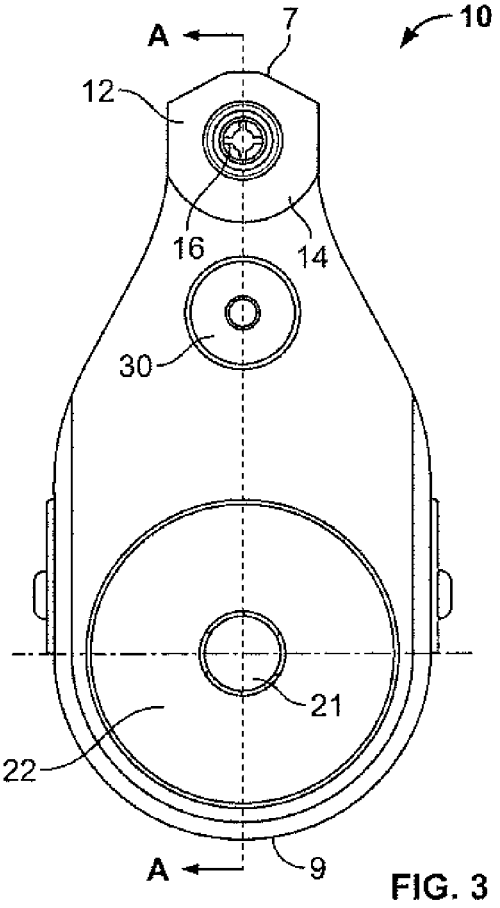
FIG. 3 is a front elevational view of the nose assembly shown in FIG. 1.

U.S. Pat. No. 7,631,534 entitled Extreme Offset Nose Assembly, issued on Dec. 15, 2009 (the "'534 patent") is incorporated by reference herein in its entirety. U.S. Pat. No. 7,458,245 (the "'245 patent") is entitled Extreme Offset Nose Assembly, issued on Dec. 2, 2008 is incorporated by reference herein in its entirety.

Referring to FIGS. 1 through 4, in an embodiment, a nose assembly 10 for a fastener installation tool includes a first end 3, a second end 5 opposite the first end 3, a top end 7, and a bottom end 9 opposite the top end 7. In an embodiment, the nose assembly 10 includes an anvil 12, a collet 14 disposed within the anvil 12 and having unitized jaws 16, and an associated deflector 18 in communication with the collet 14 (see FIG. 4). In an embodiment, the collet 14 includes an aperture 15 having internal threads 17 (see FIG. 4). In an embodiment, the anvil 12 is a swaging anvil. In another embodiment, the anvil 12 is a stand-off anvil in the case of a pull-in application. In an embodiment, the collet 14 is disposed slidably within the anvil 12. In an embodiment, the nose assembly 10 includes a drawbar 20 having a primary bearing 22 at a first end thereof and a stop 24 at second end opposite the first end. In an embodiment, the primary bearing 22 of the drawbar 20 includes an internal hexagonal recess 21 located at the first end of the drawbar 20 that is sized and shaped to receive a hexagonal key (not shown in the Figures). In an embodiment, the stop 24 of the drawbar 20 includes an internal hexagonal recess 23 that is sized and shaped to receive a hexagonal key. In an embodiment, a portion of the drawbar 20 located proximate to the primary bearing 22 contains external threads 25. In an embodiment, the external threads 25 engage threadedly the internal threads 17 of the collet 14. In an embodiment, the drawbar 20 is shrouded partially by a back guard 26 and a wrap-around guard 28. In an embodiment, the drawbar 20 is supported by the anvil 12 and the collet 14 and extends through a plurality of apertures and bores formed within the anvil 12 and the collet 14, such apertures being shown in FIG. 4 but not described herein for the sake of brevity. In an embodiment, the drawbar 20 includes a rear bearing 27 positioned intermediate the primary bearing 22 and the stop 24. In an embodiment, the anvil 12, the collet 14 and the drawbar 20 have a structure and function similar to the corresponding components disclosed in the '534 patent and the '245 patent, with certain differences as noted below.

Figure 4:
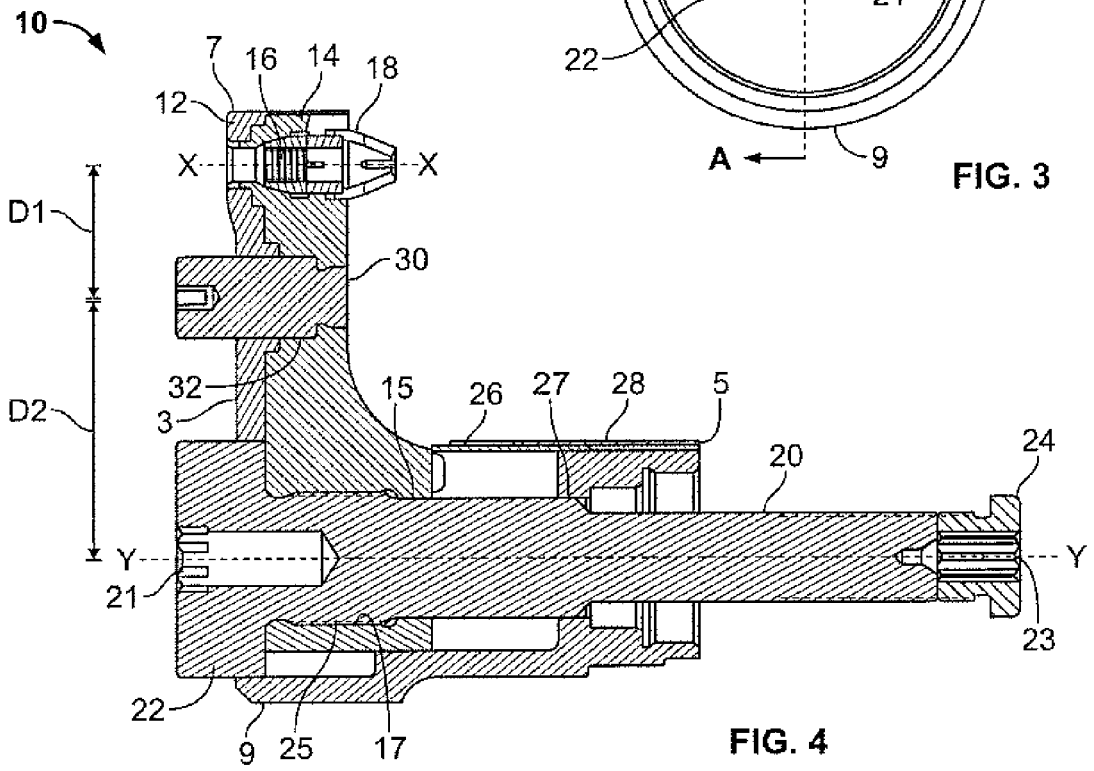
FIG. 4 is a cross-sectional view, taken along section lines A-A and looking in the direction of the arrows, of the nose assembly shown in FIG. 3.

In an embodiment, the nose assembly 10 includes a secondary bearing 30 located proximate to a fastener centerline X-X defined by a longitudinal axis of the jaws 16, and is located intermediate the fastener centerline X-X and the primary bearing 22 (see FIG. 4). In an embodiment, the secondary bearing 30 is offset from the fastener centerline X-X by a first distance D1 and is offset from a pulling tool centerline axis Y-Y defined by a longitudinal axis of the drawbar 20 by a second distance D2 (see FIG. 4). In an embodiment, the secondary bearing 30 is fastened threadedly to the collet 14 by a threaded portion 32. In another embodiment, the secondary bearing 30 is fastened to the collet 14 by any other type of connection that will support frictional forces along the pulling tool centerline axis Y-Y. In other embodiments, the secondary bearing 30 is retained to the collet 14 by a retainer ring or a retainer clip (not shown in the Figures). In an embodiment, the secondary bearing 30 has a close mating running fit with the anvil 12 which has a bore that receives and is in close communication with an outside diameter of the secondary bearing 30. In an embodiment, the foregoing arrangement limits the relative deflection between the anvil 12 and the collet 14. In an embodiment, the secondary bearing 30 supports the bending moment imposed when installing a fastener. In an embodiment, the stresses in the components of the nose assembly 10 are reduced due to the dual bearing approach, i.e., the primary bearing 22 bearing on the anvil 12 and the secondary bearing 30 bearing on the work surface (not shown).

Figure 5:
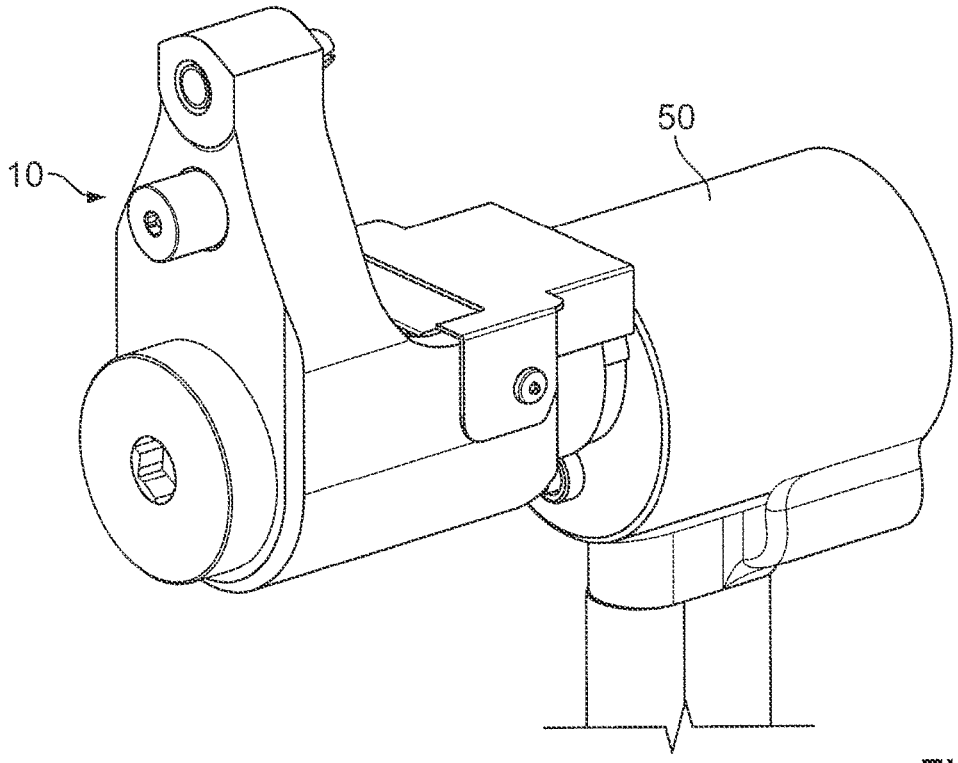
FIG. 5 is a front perspective view of the nose assembly shown in FIG. 1 attached to an installation tool.
Figure 6:
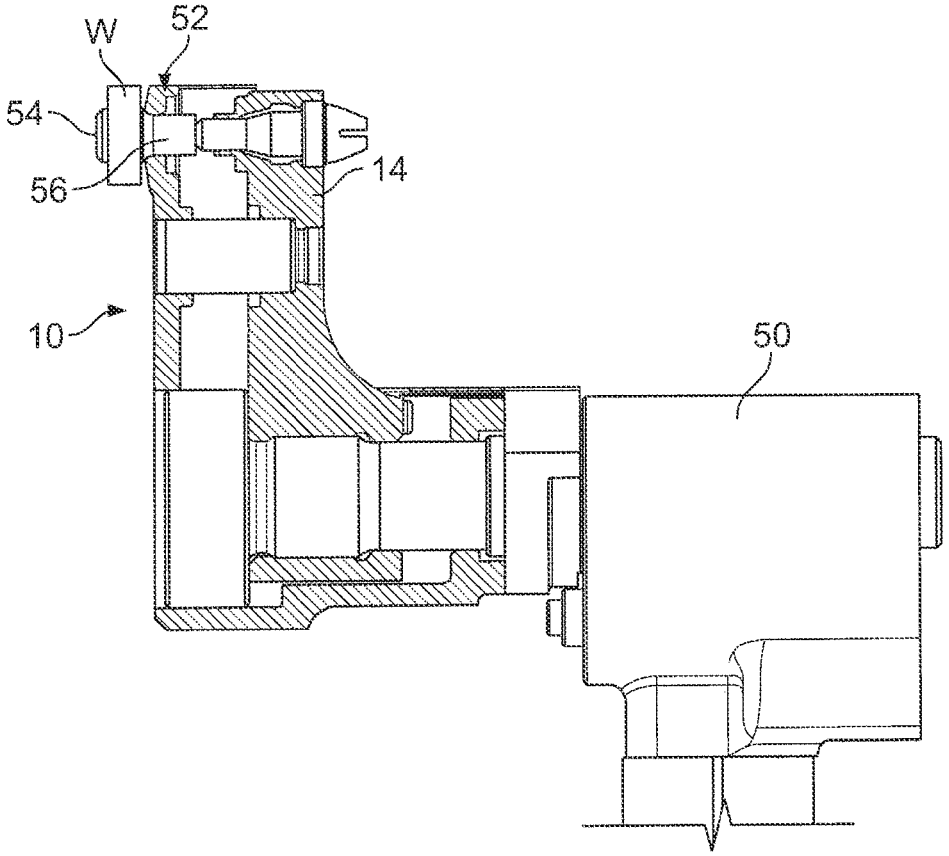
FIG. 6 is a partial cross-sectional view of the nose assembly shown in FIG. 5.

Referring to FIGS. 5 and 6, in an embodiment, the nose assembly 10 is attached to a fastener installation tool 50. In an embodiment, to assemble the nose assembly 10 to the tool 50, the drawbar 20 is installed in the collet 14 and backed-off one turn. Then, the entire nose assembly 10 is rotated onto the tool 50 until it is in a home position. Then, it is locked in with a locking disk on the tool 50 (not shown). The collet 14 is adjusted fully forward by turning the drawbar 20 via a key in the hexagonal recess 21. It is then locked in placed by tightening the stop 22 from the back of the tool 50.

As shown in FIG. 6, a fastener 52 is installed in the collet 14. In an embodiment, the fastener has a pin member 54 and swage collar 56. The nose assembly 10 engages the fastener 52 for securing a workpiece W.

Figure 7:
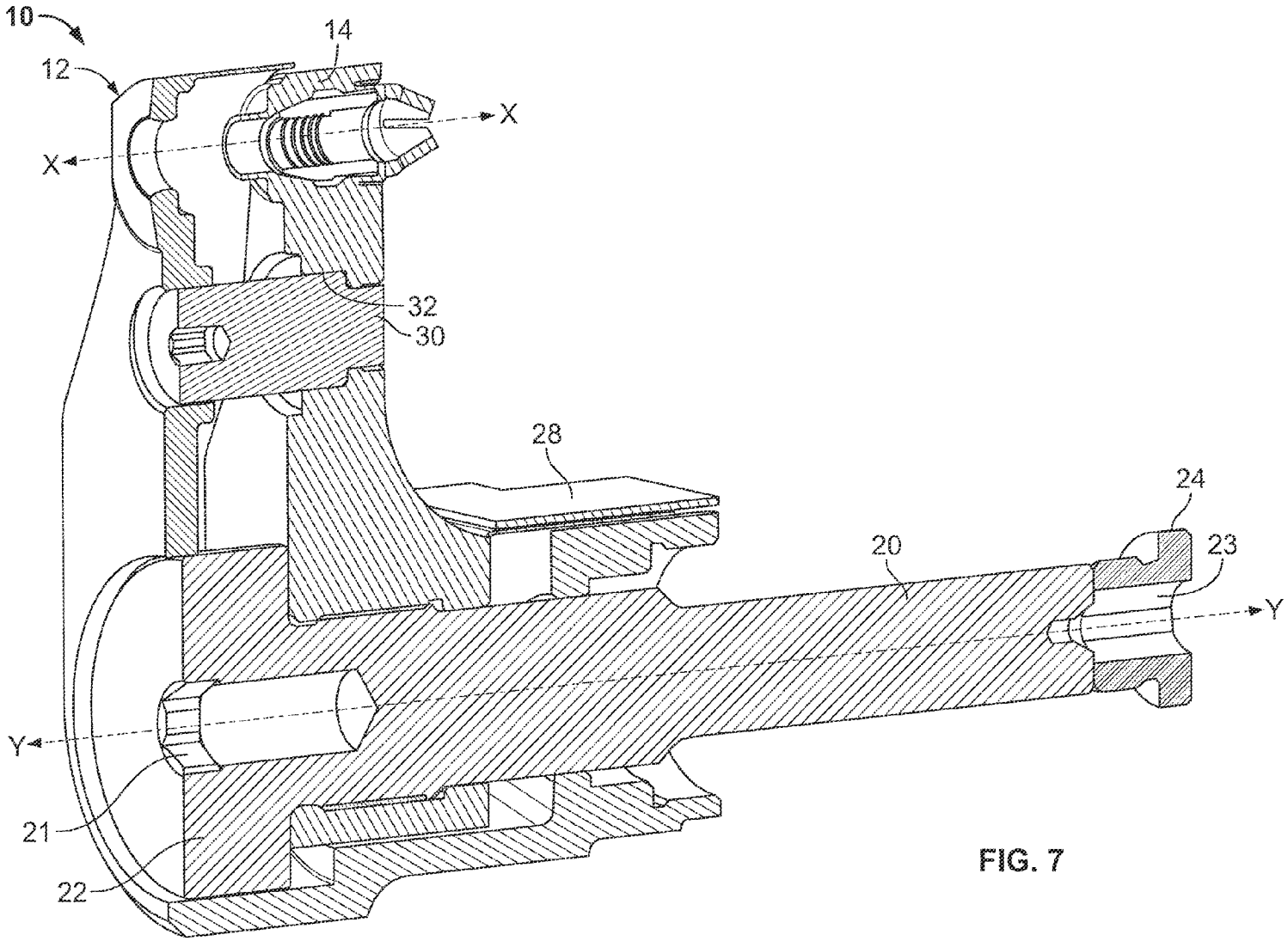
FIG. 7 is a cross-sectional view of the nose assembly shown in FIG. 1, the nose assembly activated in a pull position.

FIG. 7 shows the nose assembly 10 activated in a pull position. In an embodiment, the primary bearing 22 (in line with pulling tool centerline Y-Y) remains engaged with the anvil 12 during loaded stroke and (i) limits anvil 12 deflection relative to the fastener center line X-X and (ii) supports the installation load. In an embodiment, the secondary bearing 30 (offset from pulling tool centerline Y-Y) remains engaged with the collet 14 during the loaded stroke and limits deflection of the collet 14 relative to the fastener center line X-X. In an embodiment, the maximum deflection of the collet 14 relative to the fastener center line X-X is approximately 0.005".

Figure 8:
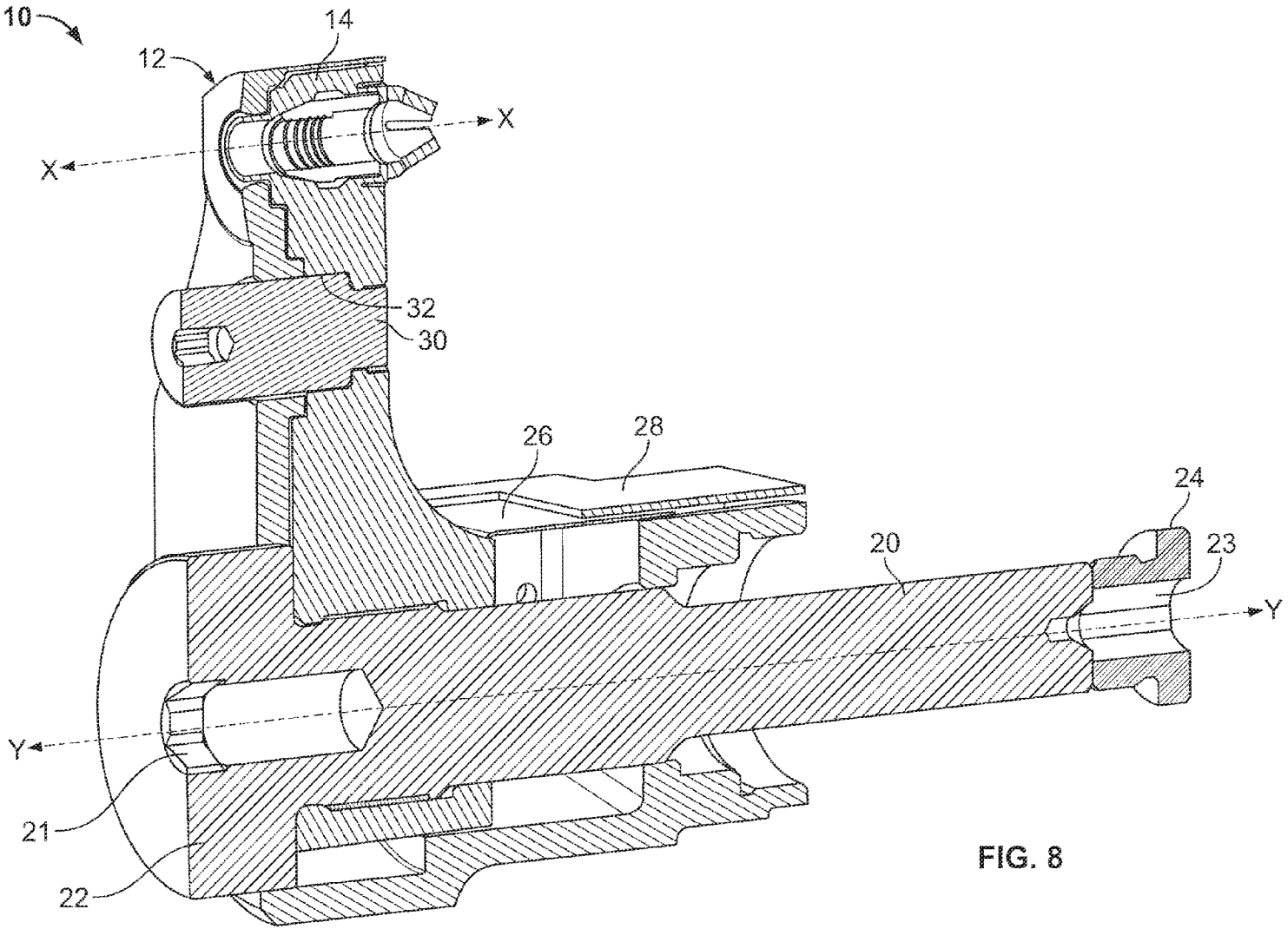
FIG. 8 is a cross-sectional view of the nose assembly shown in FIG. 7, but with the nose assembly activated in a return position.

FIG. 8 shows the nose assembly 10 in a return position. The primary bearing 22 (in line with pulling tool centerline Y-Y) remains engaged with the anvil 12 during the return stroke. The secondary bearing 30 (offset from pulling tool centerline Y-Y) remains engaged with the collet 14 during the return stroke.

In operation, once the drawbar 20 and subsequently the collet 14 are positioned in the returned position (i.e., oriented furthest away from the anvil 12), a fastener is installed in the jaws 16 of the collet 14 (i.e., oriented along the fastener centerline X-X). The loaded stroke is applied by the tool to the drawbar 20 until the primary bearing 22 bears on the anvil 12 and the secondary bearing 30 bears on the work surface and the fastener is fully installed. The return stroke is applied by the tool to the drawbar 20 until the primary bearing 22 and the secondary bearing 30 are positioned in the returned position. During the return stroke, the direction of flight of the pin tail that is broken off the shank of the fastener is redirected by the deflector 18 safely and with reduced energy.

It should be understood that the embodiments described herein are merely exemplary and that a person skilled in the art may make many variations and modifications without departing from the spirit and scope of the invention. All such variations and modifications are intended to be included within the scope of the invention as defined in the appended claims.

What is claimed is:

1. A nose assembly for a fastener installation tool, comprising:

an anvil;

a collet disposed within the anvil, the collet including jaws;

a drawbar supported by the anvil and the collet, the drawbar having a first end, a second end opposite the first end, and a primary bearing located at the first end, wherein the primary bearing is adapted to remain stationary with respect to the collet and move with respect to the anvil during operation of the fastener installation tool; and a secondary bearing positioned within the collet and located intermediate the primary bearing of the drawbar and the jaws of the collet, wherein the secondary bearing is adapted to bear on a work surface during operation of the fastener installation tool.

2. The nose assembly of claim 1, wherein the secondary bearing is offset by a first distance from a fastener centerline defined by a longitudinal axis of the jaws, and is offset by a second distance from a pulling tool centerline defined by a longitudinal axis of the drawbar.

3. The nose assembly of claim 2, wherein the first distance is less than the second distance.

4. The nose assembly of claim 3, wherein the nose assembly is adapted to be activated in a pull position, such that the primary bearing is engaged with the anvil during a loaded stroke and limits anvil deflection relative to the fastener center line and supports an installation load, while the secondary bearing is engaged with the collet during the loaded stroke and limits deflection of the collet relative to the fastener center line.

5. The nose assembly of claim 4, wherein the nose assembly is adapted to be activated in a return position, such that the primary bearing remains engaged with the anvil during a return stroke, while the secondary bearing remains engaged with the collet during the return stroke.

6. The nose assembly of claim 1, wherein the secondary bearing is attached to the collet and engaged with the anvil.

7. The nose assembly of claim 6, wherein the secondary bearing is fastened threadedly to the collet.

8. The nose assembly of claim 6, wherein the secondary bearing is retained to the collet by a retaining ring.

9. The nose assembly of claim 6, wherein the secondary bearing is retained to the collet by a retainer clip.

10. The nose assembly of claim 1, wherein the collet includes an aperture having internal threads and the drawbar includes external threads that engage threadedly the internal threads of the aperture of the collet.

11. The nose assembly of claim 1, wherein the drawbar includes a rear bearing located intermediate the first and second ends of the drawbar.

12. The nose assembly of claim 1, wherein the anvil is a swaging anvil.

13. The nose assembly of claim 1, wherein the anvil is a stand-off anvil.

14. The nose assembly of claim 1, wherein the drawbar includes a stop located at the second end thereof.

15. The nose assembly of claim 1, further comprising a deflector in communication with the collet.

* * * * *